United States Patent [19]

Ryce

[11] 4,150,682

[45] Apr. 24, 1979

[54] EXTENDABLE, RETRACTABLE AND PORTABLE SHELTER

[76] Inventor: Anne Ryce, 5D-1975 Corydon Ave., Winnipeg, Canada

[21] Appl. No.: 797,913

[22] Filed: May 18, 1977

[51] Int. Cl.[2] ..... A45F 1/16; E04B 1/347

[52] U.S. Cl. ..... 135/4 R; 135/DIG. 1

[58] Field of Search ..... 135/4 R, 4 A, DIG. 1; 296/105; 4/172.11, 172.12, 172.14

[56] References Cited

U.S. PATENT DOCUMENTS

| | | | |
|---|---|---|---|
| 1,583,039 | 5/1926 | Wickstrum | 135/4 R |
| 2,469,958 | 5/1949 | Fowler | 296/105 |
| 2,817,344 | 12/1957 | Teeter | 135/DIG. 1 X |
| 3,231,305 | 1/1966 | Beckman | 135/DIG. 1 X |
| 3,329,196 | 7/1967 | Algie | 160/84 R |
| 3,469,587 | 9/1969 | Folkes | 4/172.12 X |
| 3,629,982 | 12/1971 | Ballay et al. | 135/4 R X |
| 3,958,588 | 5/1976 | Huddle | 135/4 R |

*Primary Examiner*—Werner H. Schroeder
*Assistant Examiner*—Conrad L. Berman
*Attorney, Agent, or Firm*—Stanley G. Ade

[57] ABSTRACT

An enclosure with doors contains a plurality of arched hoops or the like having ground engaging skids and with a flexible covering attached thereto. The hoops may be pulled out manually over a car or the like parked in front of the enclosure. Locking bars lock the hoops in spaced apart relationship automatically and a bar may be provided hooking under the bumper of the car for anchoring purposes. A winch in the enclosure winds cables passing through eyes on the hoops or arches and which are anchored to the outermost arch. Means are provided to break the over-center locking action of the locking bars as the hoops are wound in by the winch until the entire assembly is contained within the enclosure.

8 Claims, 6 Drawing Figures

EXTENDABLE, RETRACTABLE AND PORTABLE SHELTER

BACKGROUND OF THE INVENTION

This invention relates to new and useful improvements in shelters, particularly portable shelters which can be used to cover cars and the like.

There is difficulty in providing any form of shelter for automobiles when garages are not available. This is particularly so in outside parking facilities provided for apartment blocks and the like.

Although portable shelters exist, these are relatively large inasmuch as means have to be provided to enable the car to be driven in the shelter and then the occupants to exit therefrom. This means that such shelters cannot normally be utilized within apartment block parking lots or the like because of the lack of space available.

SUMMARY OF THE INVENTION

The present invention overcomes these disadvantages by providing a portable shelter which is adapted to be opened and extended over the automobile or other vehicle after same has been driven into position thus completely enclosing the automobile and taking up the minimum amount of space.

One aspect of the invention is to provide an extendable or retractable shelter assembly for automobiles and the like comprising in combination an enclosure, and a shelter unit selectively situated therein, said shelter unit including a plurality of arched components, said arched components including an innermost component and an outermost component, each of said arched components including a pair of spaced and parallel substantially vertical portions and an over-spanning portion extending between the upper ends of said vertical portions, a flexible cover, means securing one end of said flexible cover within said enclosure, means securing said flexible cover to said arched components and releasable locking means between adjacent arched components to maintain same in spaced and parallel relationship when extended.

Another object of the invention is to provide a device of the character herewithin described which may include ground engaging skids or the like on the lower ends of each of the arched components to facilitate the extending and retracting of the assembly.

Another object of the invention is to provide a device of the character herewithin described which may include means extending from the outermost arched component to engage under the bumper of the automobile when the shelter unit is fully extended thus anchoring same and preventing the shelter unit from lifting due to excessive winds.

Yet another object of the invention is to provide a device of the character herewithin described which may include means to retract the shelter unit into an enclosure which can then be closed and locked when the shelter unit is not required.

A still further object of the invention is to provide a device of the character herewithin described which includes automatic locking bars to maintain the arched supports in the desired spaced and parallel relationship and which may include means to successively break the locking bars as the shelter unit is retracted.

Another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:-

DESCRIPTION OF THE DRAWINGS

In the drawings like characters of reference indicate corresponding parts in the different figures.

DETAILED DESCRIPTION

Figure 1:
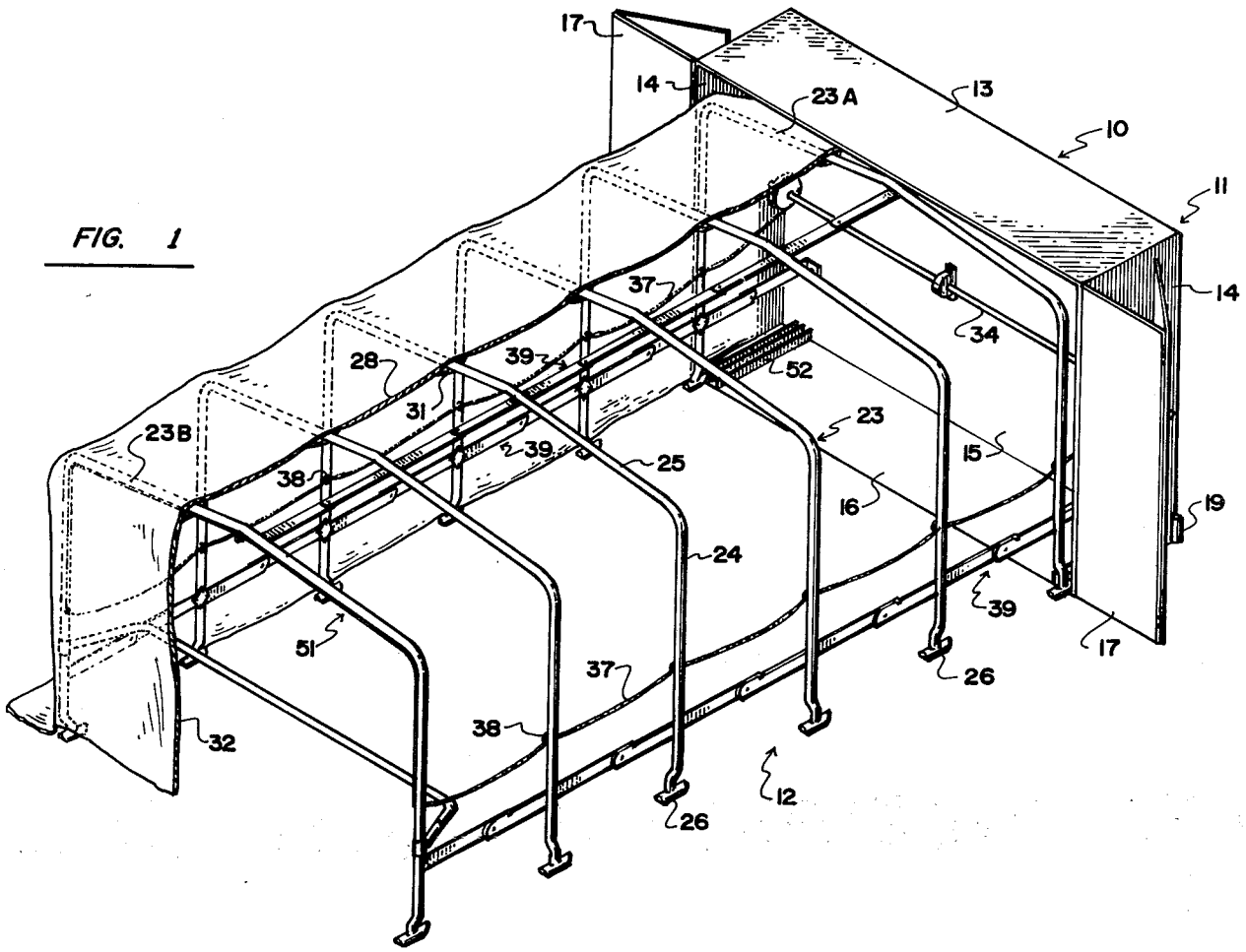
FIG. 1 is an isometric view of the device in the fully extended position and showing the flexible cover broken away in part for clarity.

Proceeding therefore to describe the invention in detail, same is generally designated by reference character 10 and includes an enclosure 11 and an extendable and retractable shelter unit collectively designated 12.

The enclosure 10 includes an outer panel 13, spaced and parallel side panels 14, a rear panel 15 and a base panel 16 with pairs of folding doors 17 hinged to the vertical front edges of the side panels 14 and adapted to enclose the enclosure and to lock same by means of a conventional handle assembly 18.

Means are provided to detachably anchor the enclosure to the ground if desired. In this regard, two methods are shown.

Vertical sleeves 19 are secured as by welding to the sides 14 adjacent the lower corners thereof. If on soft ground, stakes or pegs 20 may engage freely through the anchor brackets or sleeves 19 and into the ground. If mounted on concrete, then a threaded sleeve 21 may be engaged within the concrete and a screw threaded bolt 22 may then freely engage within the sleeve 19 and screw threadably engage within the threaded sleeve 21.

The shelter unit 12 comprises a plurality of arched components collectively designated 23, and including an innermost arched component 23A and an outermost arched component 23B.

Each arched component includes spaced and parallel substantially vertical portions 24 within an over-spanning portion 25 extending between the upper ends of each pair of vertical portions 24.

Ground engaging means are provided on the lower ends of the vertical portions 24 and preferably take the form of arcuately curved tubular skids 26 welded to said lower ends.

Figure 6:
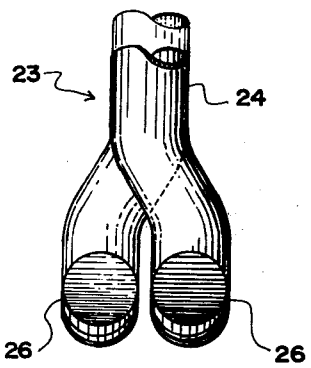
FIG. 6 is a fragmentary end view of FIG. 3.

Adjacent lower ends are offset alternatively as shown in FIG. 6 and receives the skids 26 so that when the unit 12 is fully retracted, alternate skids lie in overlapping or substantially side by side relationship as shown in FIG. 6, thus facilitating the retraction of the unit 12 within the enclosure.

It should also be noted that diagonally situated holes or drillings 27 are formed through the skids 26 through which nails or other anchoring pegs (not illustrated) may be engaged when the unit is extended if additional anchoring is required.

Figure 3:
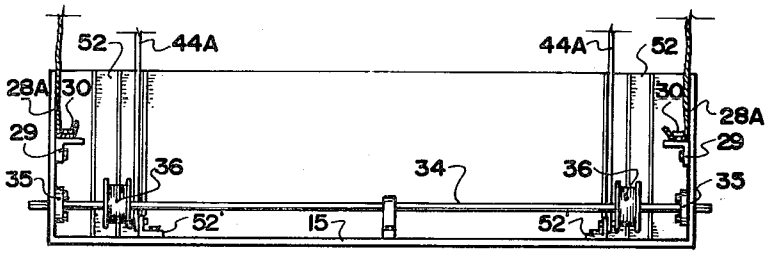
FIG. 3 is a fragmentary top plan view of the enclosure with the upper panel removed to show the interior thereof.

A flexible cover 28 is secured by the inner end thereof to within the sides of the container, being clamped by the inner end 28A between an angle iron 29 and a flat bar 30, by means of bolts or the like (not illustrated). (See FIG. 3)

The flexible cover which may be made of synthetic plastic material or canvas, which extends over all of the arched components 24 and is secured to the arched components 23 by means of fabric or plastic loops 31 sewn or otherwise attached to the material of the cover and engaging around the arched components 23 as shown in FIG. 1.

The front end of the cover 28 may include inwardly extending portions 32 to cover the front of the assembly when extended.

A winch assembly is provided within the enclosure collectively designated 33. It comprises a cross shaft 34 mounted within bearings 35 and extending beyond the sides 14 so that a crank (not illustrated) may be engaged with this shaft to rotate same.

Sheaves 36 are mounted on shaft 34 and wire cables are similar flexible cables 37 are secured by one end thereof to the sheaves 36. These cables extend through eyes 38 secured to the inside of the vertical portions 24 of the arched components and are secured by the distal ends thereof to the outermost arched components 23B.

This means that the unit 12 can be extended manually with the shaft 34 running freely and the cables extending with the unit, and that the winch assembly 33 can be utilized to retract the assembly within the container 11.

Figure 4:
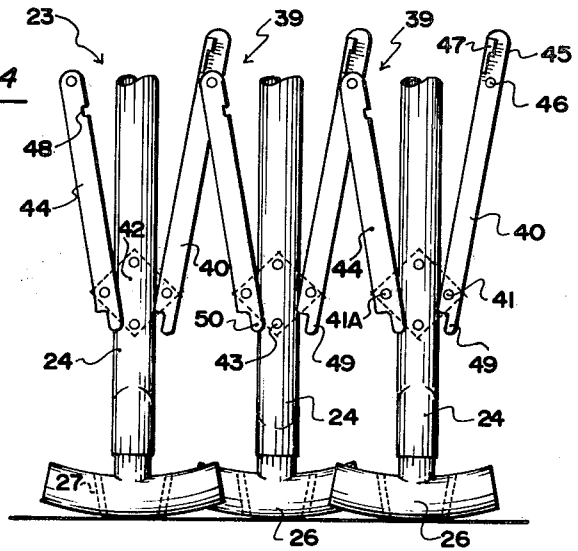
FIG. 4 is a fragmentary side elevation of three of the arched components showing same in the partially closed position.
Figure 5:
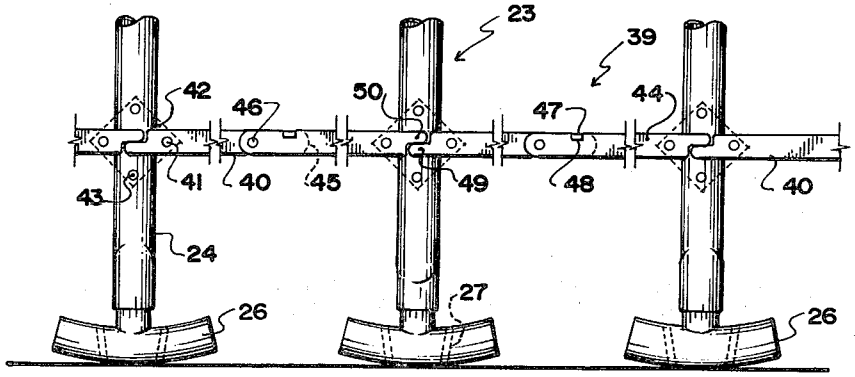
FIG. 5 is a view similar to FIG. 4, but showing the components in the fully extended position.
Figure 2:
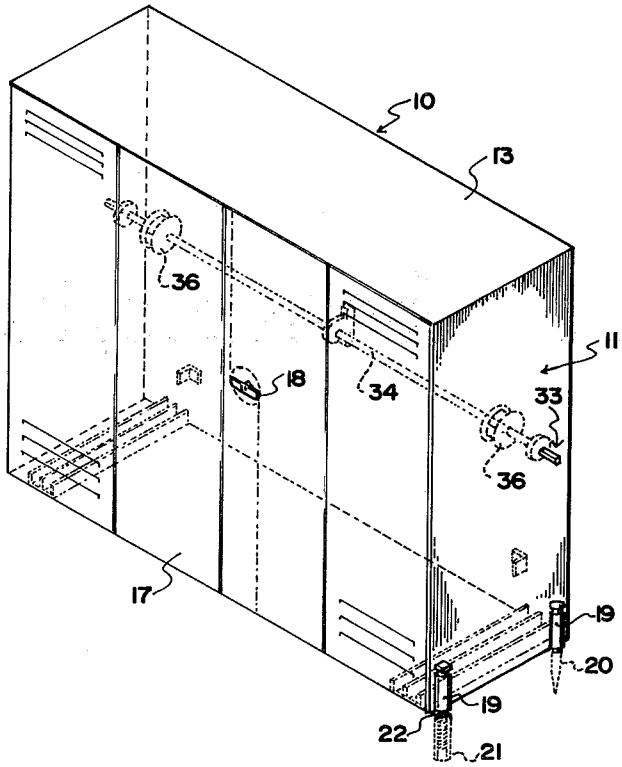
FIG. 2 is an isometric view of the device in the fully closed or retracted position.

Sets of locking bars are provided collectively designated 39, between adjacent arched components and details of these locking bars are shown in FIGS. 4 and 5.

Each locking bar set includes a first locking bar 40 pivotally secured as at 41, to an anchor plate 42 which in turn is secured by rivets 43 to the vertical portion 24 of the arched components 23.

A second locking bar 44 is pivotally secured as by pivot 41A, to the adjacent arched component and these two locking bars 40 and 44 pivotally secured together by the other ends 45 thereof by means of pivot 46.

When in the fully extended position shown in FIG. 5, pivot 46 is on a slightly lower plane than pivots 41 and 41A. In other words, the locking bars have passed over-center and are locked in position by means of an off-standing lug 47 engaging within a notch 48, it being understood that the lug 47 is on one locking bar 40 and notch 48 is on the corresponding locking bar 44.

When in the over-center position, as for example when the unit is fully extended, the unit is fully locked in position so that the canvas is extended covering the automobile or the like within the shelter unit 12.

When it is desired to retract the unit, means are provided to successively break the locking bars between adjacent arched components and in this regard, reference should once again be made to FIGS. 4 and 5.

The first locking bar 40 is provided with a lower lug 49 extending beyond the pivot 41 and the second locking bar 44 is provided with an upper lug 50 extending beyond the pivot 41A.

Adjacent locking bars 40 and 44 which are mounted on the same plate 42, are positioned so that the lugs of these adjacent bars are in the relationship shown in FIG. 5, when the assembly is fully extended.

However, if the winch assembly 33 is used to retract the unit, the locking bars between the outermost arched components 23B and the next adjacent components 23 are initially broken by means of a lever and rod assembly collectively designated 51. However, as the outermost component 23B is winched by cable 37 towards the next adjacent component 23, the lugs 41 and 50 engage one another thus lifting the pivot 46 between the next adjacent components 23 thus breaking the over-center locking bars and permitting the assembly to be retracted, it being understood that the locking bars between adjacent components are broken successively as the unit is withdrawn into the enclosure 11.

As the skids 26 approach the enclosure, alternate skids engage within channel guides 52 secured to the floor 16 of the enclosure thus facilitating the positioning of these skids and enabling the entire unit 12 to be withdrawn completely into the enclosure whereupon the doors may be closed and locked.

It will be observed that the innermost locking bar specifically designated 44A is pivotally secured to a bracket 52 secured in turn to the rear panel 15 of the enclosure.

Since various modifications can be made in my invention as hereinabove described, and many apparently widely different embodiments of same made within the spirit and scope of the claims without departing from such spirit and scope, it is intended that all matter contained in the accompanying specification shall be be interpreted as illustrative only and not in a limiting sense.

What I claim as my invention is:

1. An extendable and retractable shelter assembly for automobiles and the like comprising in combination an enclosure, and a shelter unit selectively situated therein, said shelter unit including a plurality of arched components, said arched components including an innermost component and an outermost component, each of said arched components including a pair of spaced and parallel substantially vertical portions and an over-spanning portion extending between the upper ends of said vertical portions, a flexible cover, means securing one end of said flexible cover within said enclosure, means securing said flexible cover to said arched components and releasable locking means between adjacent arched components to maintain some in spaced and parallel relationship when extended, said releasable locking means including a first locking arm pivotally secured by adjacent one end thereof to one of said arched components, a second locking arm pivotally secured by adjacent one end thereof to the next adjacent arched component, said first and second locking arms being pivotally secured together by adjacent the other ends thereof and between said adjacent arched components and over-center stop means on one of said locking arms operatively engaging the other of said locking arms when extended, and means to release successively, said locking arms between adjacent arched components as said shelter unit is retracted, said means including a lower lug extending from said one end thereof of one of said locking arms pivotally secured to one of said arched components and an upper lug extending from said one end of the other of said locking arms pivotally secured to the same said one arched component, said upper lug operatively engaging said lower lug as said shelter unit is retracted thereby raising said other end of said one locking arm.

2. The assembly according to claim 1 which includes means to retract said shelter unit into said enclosure, said last mentioned means including a winch system within said enclosure, cables extending from said winch system to said outermost arched component and being secured thereto, guide means on the other of said arched components, said cables passing freely through said guide means.

3. The assembly according to claim 1 which includes ground engaging means at the lower ends of said vertical portions of said arched components, said last mentioned means being secured to said lower ends whereby said ground engaging means of adjacent components are in overlapping relationship when said shelter unit is retracted within said enclosure.

4. The assembly according to claim 3 which includes means extending from said outermost arched component for selectively anchoring said outermost component when in the extended position.

5. The assembly according to claim 3 which includes means to retract said shelter unit into said enclosure, said last mentioned means including a winch system within said enclosure, cables extending from said winch system to said outermost arched component and being secured thereto, guide means on the other of said arched components, said cables passing freely through said guide means.

6. The assembly according to claim 3 in which said ground engaging means includes a skid shoe at the lower ends of each of said vertical portions of said arched components, and guide means in said enclosure to receive and guide said shoe when said assembly is retracted within said enclosure.

7. The assembly according to claim 1 which includes means extending from said outermost arched component for selectively anchoring said outermost component when in the extended position.

8. The assembly according to claim 7 which includes means to retract said shelter unit into said enclosure, said last mentioned means including a winch system within said enclosure, cables extending from said winch system to said outermost arched component and being secured thereto, guide means on the other of said arched components, said cables passing freely through said guide means.

* * * * *